US009296019B2

(12) United States Patent
Berghmans et al.

(10) Patent No.: US 9,296,019 B2
(45) Date of Patent: Mar. 29, 2016

(54) METHOD FOR DISCERNING AND SORTING PRODUCTS WHEREBY THE CONCENTRATION OF A COMPONENT OF THESE PRODUCTS IS DETERMINED

(75) Inventors: Paul Berghmans, Scherpenheuvel (BE); Christiaan Fivez, Wilsele (BE); Johan Speybrouck, Brussels (BE)

(73) Assignee: TOMRA SORTING NV, Leuven (BE)

( * ) Notice: Subject to any disclaimer, the term of this patent is extended or adjusted under 35 U.S.C. 154(b) by 314 days.

(21) Appl. No.: 13/379,264

(22) PCT Filed: Jun. 17, 2010

(86) PCT No.: PCT/BE2010/000047

§ 371 (c)(1),
(2), (4) Date: Dec. 19, 2011

(87) PCT Pub. No.: WO2010/144974

PCT Pub. Date: Dec. 23, 2010

(65) Prior Publication Data

US 2012/0097583 A1 Apr. 26, 2012

(30) Foreign Application Priority Data

Jun. 17, 2009 (BE) ..... 2009/0365

(51) Int. Cl.
*B07C 5/00* (2006.01)
*B07C 5/342* (2006.01)

(52) U.S. Cl.
CPC ..... *B07C 5/342* (2013.01)

(58) Field of Classification Search
CPC ..... B07C 5/342
USPC ..... 209/576, 577, 578, 587, 939
See application file for complete search history.

(56) References Cited

U.S. PATENT DOCUMENTS

| | | | | | |
|---|---|---|---|---|---|
| 3,295,406 | A | * | 1/1967 | Smith | 356/414 |
| 4,099,620 | A | * | 7/1978 | Kendall et al. | 209/587 |
| 4,122,952 | A | * | 10/1978 | Richards | 209/579 |
| 4,166,541 | A | * | 9/1979 | Smith, Jr. | 209/587 |
| 4,373,638 | A | * | 2/1983 | Schapper | 209/570 |
| 4,634,881 | A | * | 1/1987 | Billion | 250/559.45 |
| 4,679,075 | A | * | 7/1987 | Williams et al. | 348/127 |
| 4,723,659 | A | * | 2/1988 | Billion | 209/576 |
| 5,397,819 | A | | 3/1995 | Krutak et al. | |

(Continued)

FOREIGN PATENT DOCUMENTS

| | | | |
|---|---|---|---|
| GB | 2236848 | A | 4/1991 |
| WO | WO 9411126 | A1 | 5/1994 |

(Continued)

*Primary Examiner* — Patrick Cicchino
(74) *Attorney, Agent, or Firm* — Buchanan Ingersoll & Rooney P.C.

(57) ABSTRACT

The invention concerns a method for discerning and sorting suitable products in a product flow having a certain concentration of a component versus anomalous products having this component in an anomalous concentration, whereby a beam of light strikes these products, and the absorption of this beam of light by said component in the products is detected by measuring the intensity of the light reflected by the products at least at a wavelength or in at least a wavelength band which is situated between 900 nm and 2500 nm in order to generate a detection signal on the basis of said absorption, whereby a product will be identified as an anomalous product if said detection signal exceeds a threshold value.

27 Claims, 1 Drawing Sheet

(56) References Cited

U.S. PATENT DOCUMENTS

| | | | | |
|---|---|---|---|---|
| 6,734,383 | B1 * | 5/2004 | Calcoen et al. | 209/577 |
| 6,864,970 | B1 * | 3/2005 | Ruymen et al. | 356/237.1 |
| 2003/0197126 | A1 * | 10/2003 | Sato et al. | 250/339.11 |
| 2004/0251177 | A1 * | 12/2004 | Lofqvist et al. | 209/577 |
| 2009/0152177 | A1 * | 6/2009 | Greenspan et al. | 209/580 |
| 2010/0193412 | A1 * | 8/2010 | Mack et al. | 209/585 |
| 2010/0198397 | A1 * | 8/2010 | Berghmans | 700/223 |
| 2012/0021101 | A1 * | 1/2012 | Berghmans et al. | 426/231 |
| 2012/0074047 | A1 * | 3/2012 | Deefholts | 209/587 |
| 2013/0056398 | A1 * | 3/2013 | Adams et al. | 209/587 |

FOREIGN PATENT DOCUMENTS

| | | | |
|---|---|---|---|
| WO | WO 03004179 | A1 | 1/2003 |
| WO | WO 2009030004 | A1 | 3/2009 |
| WO | WO 2009063023 | A1 | 5/2009 |

* cited by examiner

METHOD FOR DISCERNING AND SORTING PRODUCTS WHEREBY THE CONCENTRATION OF A COMPONENT OF THESE PRODUCTS IS DETERMINED

The invention concerns a method for optically sorting preferably granular products, in particular for discerning and sorting suitable products having a specific concentration of a component, of anomalous products having said component in an anomalous concentration. According to this method, a beam of light strikes the products moving in a wide product flow, and the intensity of the light reflected by the products is measured so as to generate a detection signal which makes it possible to discern suitable products from anomalous products. In order to sort the products, a removal device is controlled by means of said detection signal so as to separate anomalous products from the product flow.

According to the known methods according to the present state of the art, a beam of light is directed towards the products, and the intensity of the light which is scattered by the products and/or which is directly reflected by the products is detected. Such a detection makes it possible to sort products on the basis of their colour or their structure. Such methods are described for example in documents U.S. Pat. No. 4,634,881, U.S. Pat. No. 4,723,659 or U.S. Pat. No. 6,864,970.

These methods use a beam of light, in particular a laser beam with a wavelength situated between 380 nm and 750 nm, whereby the light which is scattered, or directly reflected by the products is detected by a detector which is sensitive to the wavelength of the beam of light hitting the products. However, if anomalous products need to be detected having the same colour and practically the same structure as suitable products, these existing methods turn out to be inadequate for accurate sorting. Thus, it is difficult for example to discern green-coloured vegetables from certain green-coloured synthetic materials.

Document U.S. Pat. No. 6,734,383 describes a sorting machine whereby the presence of certain components in the products, such as chlorophyll or aflatoxins, is detected by means of fluorescence. Indeed, it appears that whenever these components are excited with light having a certain wavelength, they will emit light having another wavelength.

However, sorting on the basis of fluorescence is not feasible for many components, since such fluorescence does not occur for many components at the wavelengths of light which is used for sorting purposes, or as the fluorescence is too weak to obtain a reliable product sorting.

The invention aims to remedy these disadvantages by providing a method which makes it possible to discern products in a reliable manner and to sort them, practically independent of the structure, in particular independent of the scattering of light by the products, and of the colour of the products. Moreover, the invention makes it possible to obtain a high contrast between the detection signal of a suitable product and that of an anomalous product, such that the products can be discerned and sorted in a very reliable and accurate manner.

To this aim, a beam of light is made to strike the products, and the absorption of this beam of light by said component in the products is detected by measuring the intensity of the light which is reflected by the products at least at a wavelength or at least within a wavelength band situated between 900 nm and 2500 nm so as to generate a detection signal on the basis of said absorption. A product will hereby be identified as an anomalous product if said detection signal exceeds a threshold value.

Practically, said absorption is detected at a wavelength or within a wavelength band of said beam of light in which said component has an absorption peak for the light of this beam of light.

Advantageously, said beam of light has at least a wavelength or a wavelength band which is situated between 900 nm and 2500 nm.

According to an interesting embodiment of the method according to the invention, the beam of light has at least two different wavelengths, and the absorption of this beam of light by the products is detected at these two different wavelengths, whereby said detection signal is generated as a function of a change in the absorption of the beam of light by the products at these wavelengths.

Preferably, said detection signal is generated by the detected absorption of the beam of light at a first wavelength, where a suitable product and an anomalous product show practically the same absorption of the beam of light by said component, comparable to the detected absorption by that component at a second wavelength of the beam of light, where a suitable product and an anomalous product have a different absorption by said component.

According to a preferred embodiment of the method according to the invention, said products are moved in a wide flow having a thickness of about a single product, whereby said beam of light is moved over the width and crosswise to the direction of movement of the product flow, such that it scans the products.

Said absorption of the beam of light by said component of the products is detected for example by means of an Indium Gallium Arsenide photo detector.

Further, said component may be formed of water, oil, sugar, proteins, starch, cellulose and/or nicotine. If this component is formed of water, for example, the absorption of said beam of light by the products will preferably be detected at a wavelength of 760 nm, 970 nm, 1200 nm, 1450 nm, 1940 nm and/or 1970 nm.

Other particularities and advantages of the invention will become clear from the following description of a few specific embodiments of the method according to the invention. This description is given as an example only and does not limit the scope of the claimed protection in any way; the figures of reference used hereafter refer to the accompanying drawings.

Figure 1:
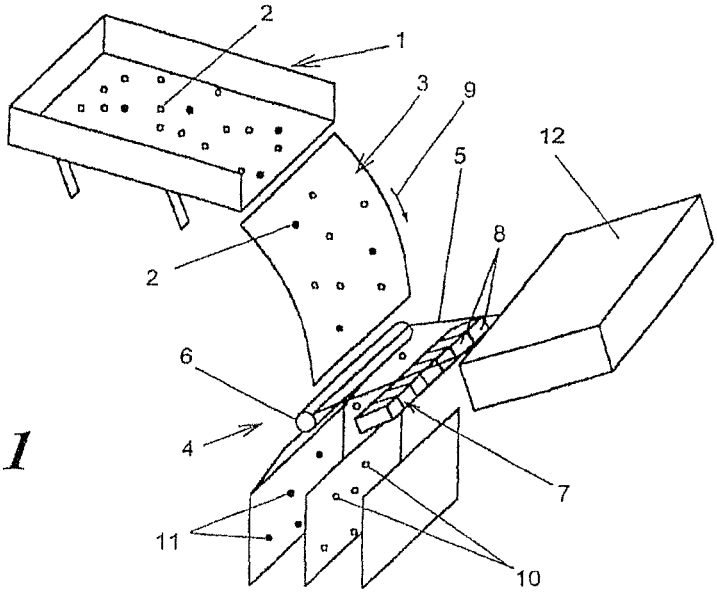
FIG. 1 is a schematic view in perspective of a sorting machine to apply the method according to the invention.

In the different figures, the same figures of reference refer to identical or analogous elements.

The method according to the invention makes it possible to discern or sort products as a function of the presence of a specific component in the products. Such a component may consist for example of water, oil, sugar, proteins, starch, cellulose or nicotine. Suitable products hereby contain a specific concentration of this component, whereas products which do not contain this component or which contain it in an anomalous concentration are considered to be anomalous products which need to be removed from the product flow during the sorting.

In order to thus detect anomalous products, a beam of light is made to strike these products, and the intensity of the light reflected by the products is measured. A beam of light is hereby selected having a wavelength for which said component has an absorption peak. Thus, according to the method of the invention, the presence or absence of the component concerned in the products is detected by determining the absorption of the light of said beam of light at the wavelength concerned or in a wavelength band comprising this wavelength. To this end, a threshold value for the intensity of the reflected or the absorbed light is selected as a function of, for example, the minimal or maximal concentration of the component concerned which is present in a suitable product.

When it is thus established that the intensity of the light which is reflected by a product deviates from the intensity of the light which is reflected by a desired product and thus exceeds said threshold value, this product is discerned as an anomalous product and it will be removed from the product flow.

By an absorption peak of a component is understood a wavelength or a wavelength band in which the absorption spectrum for this component has a maximum value between two successive minimum values in the absorption spectrum. According to the invention, the absorption of the beam of light by a component is thus detected at the wavelength which corresponds to the maximum value of the absorption peak or at a wavelength situated between said successive minimum values in this spectrum. The absorption of the beam of light by the component concerned can also be detected in a wavelength band which is at least mainly situated between said successive minimum values, whereby this wavelength band preferably but not necessarily comprises the wavelength which corresponds to the maximum value of the absorption peak.

According to the invention, said absorption peak is selected in a wavelength band of 900 to 2500 nm, and the reflected light is thus detected in this band. The selection of this wavelength band makes sure that the absorption of the light is not influenced by the colour of the products. Indeed, if an absorption peak were selected which is situated in the visible light, the absorption and reflection of the beam of light would largely depend on the colour of the products and, as a consequence, the concentration of a component thereof cannot be detected in a reliable manner by means of the absorption of the beam of light.

Thus, said beam of light has at least a wavelength or a wavelength band which is situated between 900 nm and 2500 nm. Advantageously, the wavelength or the wavelength band of this beam of light is situated between about 1150 nm and 2500 nm.

Thus, for example, a distinction can be made between aqueous products, such as for example vegetables, and non-aqueous products, such as for example synthetic material, by using a beam of light with a wavelength in the order of magnitude of 1450 nm. At this wavelength, aqueous products strongly absorb the beam of light, whereas for non-aqueous products there is practically no absorption of the beam of light.

A possible embodiment of a sorting machine for applying the method according to the invention is represented in FIG. 1. This sorting machine is provided with a vibrating table 1 onto which the products to be sorted 2 are supplied. These products comprise suitable products 10 as well as anomalous products 11. As a result of the vibrations of said vibrating table 1, the products 2 are guided to a drop plate 3. As a result of the forces of gravity, the products 2 move over the surface of the drop plate 3 in a wide product flow having a thickness of about one product over practically its entire width, whereby they leave the drop plate 3 at its lower edge. Next, the products 2 move in free fall in a product flow through a detection zone 4 where they are scanned by a beam of light 5 moving crosswise over the product flow.

As already mentioned above, this beam of light 5 has a wavelength which corresponds to an absorption peak of the component whose concentration or whose presence or absence determines whether a product is discerned as a suitable product or as an anomalous product.

In the detection zone 4, the product flow moves over a background element 6 extending over the entire width of the product flow. The background element 6 is placed such that the beam of light 5 scanning the product flow will hit said background element 6 whenever there is no product 2 in the path of the beam of light 5.

Downstream the detection zone 4, the products 2 from the product flow move along a removal device 7 which makes it possible to remove anomalous products from the product flow. The removal device 7 consists of a row of compressed air valves 8 situated next to one another which extends parallel to the product flow and crosswise to the direction of movement 9 of the latter. Each of the compressed air valves 8 is provided with a blow nozzle which is directed to the product flow. When a product 2 is thus qualified as an anomalous product 11, a compressed air valve 8 will be opened in a position corresponding to that of the anomalous product 11, such that the latter, under the influence of the thus generated compressed air flow, will be blown out of the product flow. Thus are generated a product flow 10 with practically no anomalous products 11 and a flow with practically merely anomalous products 11, separated from the latter.

Further, the sorting machine comprises a detection device 12 which makes it possible to generate said beam of light 5 and to detect the light reflected by the products 2 in said detection zone 4.

Figure 2:
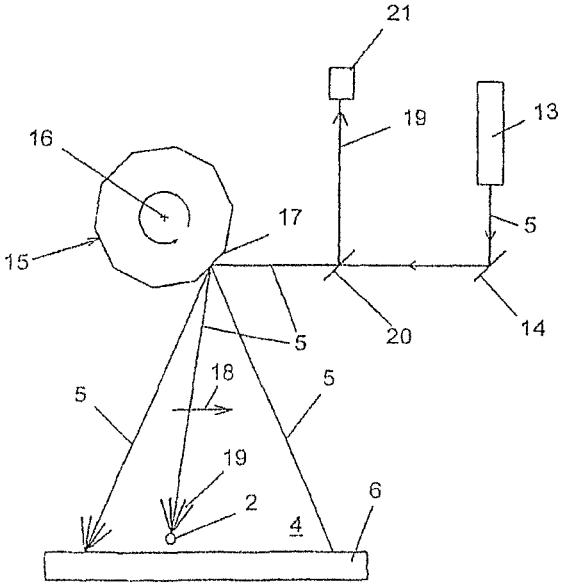
FIG. 2 is a schematic representation of a detection device for a sorting machine according to the invention.

As is schematically represented in FIG. 2, this detection device comprises a light source 13 for generating the beam of light 5 having a wavelength of 900 to 2500 nm. This light source 13 preferably consists of a laser source and thus generates a laser beam having a wavelength which is situated between 900 and 2500 nm.

The beam of light 5 is reflected as of the light source 13 via a mirror 14 to a polygon mirror 15 which rotates round a central axis 16 thereof. This polygon mirror 15 has successive mirror faces 17 on its perimeter. The beam of light 5 hereby hits the polygon mirror 15 and is directed via a mirror face 17 thereof to the product flow and to said background element 6. As a result of the rotation of the polygon mirror, the beam of light 5 moves over the entire width of the product flow as indicated by arrow 18 and thus scans the products 2 to be sorted.

When the beam of light 5 hits a product to be sorted 2, at least part of the light will be reflected by said product 2 as indicated by the arrows 19. The light 19 which is thus reflected, is sent via the polygon mirror 15 and a beam separator 20 to a detector 21.

The detector 21 consists for example of an Indium Gallium Arsenide photo detector which is sensitive to wavelengths between some 900 nm and 2500 nm.

According to an interesting embodiment of the method according to the invention, said beam of light has at least two different wavelengths, and the absorption of the beam of light by the products is detected at these different wavelengths. A detection signal is then generated as a function of a change in the absorption of the beam of light by the products between these wavelengths.

This makes it possible to improve the contrast between the detection signal for a suitable product and the detection for an anomalous product with regard to the situation whereby the absorption of the beam of light is detected at only a single wavelength.

In particular, said detection signal is generated by comparing the absorption detected at a first wavelength, where a suitable product and an anomalous product represent an absorption of the beam of light by said component to practically the same extent, with the absorption by that component detected at a second wavelength, where a suitable product and an anomalous product represent a different absorption by said component.

If said component consists for example of water, 1335 nm will be selected as a first wavelength, for example. At this first wavelength, light is absorbed in a similar manner by aqueous and non-aqueous products. As a second wavelength is then selected for example 1500 nm, whereby there is a clear difference in absorption of this light for aqueous and non-aqueous products.

Said detection signal is then generated in an interesting manner by calculating the difference between the detected absorption or intensity at said first wavelength and the one at said second wavelength, and by dividing this difference by the sum of the detected absorption or intensity at said first wavelength and said second wavelength.

The following table represents some examples of wavelengths, expressed in nanometer, corresponding to the maximum value of the absorption peaks of possible product components.

| Protein | Starch | Oil | Water | Cellulose | Sugar | Nicotine |
|---|---|---|---|---|---|---|
| 1018 | 918 | 1161 | 760 | 978 | 2080 | 1419 |
| 1143 | 979 | 1212 | 970 | 1363 | | 2270 |
| 1187 | 1430 | 1387 | 1190 | 1425 | | |
| 1485 | 1700 | 1703 | 1450 | 1460 | | |
| 1690 | 1928 | 1722 | 1550 | 1702 | | |
| 1972 | 2100 | 1760 | 1940 | 1825 | | |
| 2055 | 2282 | 2142 | | 2079 | | |
| 2162 | 2320 | 2306 | | 2103 | | |
| 2265 | 2485 | 2342 | | 2268 | | |
| 2300 | | | | 2335 | | |
| 2345 | | | | 2355 | | |
| 2462 | | | | 2480 | | |

Consequently, these wavelengths, and the wavelengths or wavelength bands from the corresponding absorption peaks, can be used in the method according to the invention for sorting products as a function of the concentration of the component concerned that they contain.

Thus, it is possible to sort fruit for example as a function of its ripeness by detecting the absorption of the beam of light for one or several of the absorption peaks for water, sugar or oil, for example. The beam of light hereby comprises light having a wavelength or a wavelength band which corresponds to the wavelength or the wavelength band of the light whose absorption is being detected.

If for example worms or any other animal elements must be removed from a product flow, light will be used containing a wavelength which corresponds to an absorption peak for proteins, and the intensity of the light which is reflected at this wavelength will be detected. If it is thus found that for a certain product from the product flow, the reflected light intensity at this wavelength is lower, than a preset value and, consequently, an absorption peak is detected, this product will be removed from the product flow as an unsuitable product which as a rule contains animal components such as for example a worm.

The beam of light may further consist of a laser beam which is possibly composed of laser rays with different wavelengths or which can be generated by a supercontinuum light source.

The method according to the invention also makes it possible to generate a detection signal as a function of the detected absorption at absorption peaks for different components. Thus, according to an interesting embodiment of the method according to the invention, for example a mixture of different products is sorted, whereby unsuitable products must be removed from this mixture. Such a mixture contains for example wet sweet products and dry non-sweet products. Thus, for this mixture, the absorption of the beam of light by the products is detected at an absorption peak for water and at an absorption peak for sugar. If the absorption of the beam of light by a product at the absorption peak for water exceeds a certain threshold value and, moreover, the absorption of the beam of light at the absorption peak for sugar exceeds a threshold value in the opposite direction, this product is a wet and non-sweet product and it will be identified as an undesired product. A product which is established as a dry and sweet product, following the detection of the absorption of the beam of light at said absorption peaks for water and sugar, is also identified as an unsuitable product.

Thus, a detection signal is generated as a function of the detection of the absorption of the beam of light by the products for the wavelengths or the wavelength bands of the absorption peaks for several components of the products to be sorted. In particular, an absorption peak is selected for each component on the basis of which one wishes to sort the products, whereby the absorption of the beam of light at the selected absorption peak for the different components is detected. It is preferably made sure hereby that the selected absorption peaks do no not overlap or overlap only minimally.

Consequently, in such a case, the beam of light has several wavelengths or wavelength bands corresponding to those of the absorption peaks to be detected.

Naturally, the invention is not restricted to the above-described embodiments of the method and the sorting machine for discerning and sorting products.

Thus, the products can be supplied to the detection device in a product flow, for example, by means of a conveyer belt instead of a vibrating table followed by a drop plate.

Also other means than a rotating polygon mirror can be used to move the beam of light over the product flow in the detection zone. For example, the beam of light can be moved over the product flow by striking a mirror moving to and fro.

Further, the beam of light may also comprise light with an additional wavelength situated outside the band of 900 nm to 2500 nm, whereby an extra detector is provided which is sensitive to this additional wavelength in order to sort the products for example also as a function of their colour and/or structure.

The invention claimed is:

1. A method for discerning and sorting suitable products in a product flow having a certain concentration of water versus anomalous products having water in an anomalous concentration, the method comprising:

striking the products with a beam of light;

detecting absorption of this beam of light by water in the products by measuring the intensity of the light reflected by the products at least at a wavelength of 760 nm, 970 nm, 1200 nm, 1450 nm, and/or 1550 nm;

generating a detection signal where water shows an absorption peak; and identifying a product as an anomalous product if said detection signal exceeds a threshold value.

2. The method according to claim 1, wherein said suitable products contain no concentration or a specific concentration of water and are discerned from said anomalous products containing water in an anomalous concentration.

3. The method according to claim 1, the method further comprising:

moving said products in a wide flow having a thickness of about a single product; and moving said beam of light crosswise over the width of the product flow, such that the beam of light scans said products.

4. The method according to claim 1, wherein said beam of light comprises a laser beam.

5. The method according to claim 1, the method further comprising controlling a removal device on the basis of said detection signal in order to separate anomalous products from the flow of products to be sorted.

6. The method according to claim 1, the method comprising detecting said absorption by an Indium Gallium Arsenide photo detector.

7. The method according to claim 1, the method comprising:

sorting a mixture of products containing different components by selecting at least one absorption peak for each component on the basis of which one wishes to sort the products, detecting absorption of the beam of light by the products at the selected absorption peak for the different components, and, generating said detection signal a function of the detected absorption of the beam of light by the products for the wavelengths or wavelength bands of the absorption peaks for said different components.

8. The method according to claim 7, wherein said component is formed of water, oil, sugar, proteins, starch, cellulose or nicotine.

9. A method for discerning and sorting suitable products in a product flow having a certain concentration of a component versus anomalous products having this component in an anomalous concentration, the method comprising:

striking the products with a beam of light;

detecting absorption of this beam of light by said component in the products by measuring the intensity of the light reflected by the products at least at two wavelengths between 900 nm and 2500 nm, wherein at least one of said wavelengths is a wavelength where said component shows an absorption peak;

generating a detection signal as a function of a change in the absorption of the beam between two wavelengths; and identifying a product as an anomalous product if said detection signal exceeds a threshold value.

10. The method according to claim 9, wherein said component is formed of proteins and said suitable products contain no concentration or a specific concentration of proteins and are discerned from said anomalous products containing proteins in an anomalous concentration, wherein said beam of light comprises light having a wavelength of some 1018 nm, 1143 nm, 1187 nm, 1485 nm, 1690 nm, 1972 nm, 2055 nm, 2162 nm, 2265 nm, 2300 nm, 2345 nm or 2462 nm or having a wavelength for which an absorption peak for proteins, corresponding to at least one of said wavelengths, is discernible, the method comprising detecting the absorption of this beam of light in the products by measuring the intensity of the light which is reflected by the products at said wavelength of the beam of light and generating said detection signal on the basis of said absorption.

11. The method according to claim 9, wherein said component is formed of sugar and said suitable products contain no concentration or a specific concentration of sugar and are discerned from said anomalous products containing sugar in an anomalous concentration, wherein said beam of light comprises light having a wavelength of some 2080 nm or having a wavelength for which an absorption peak for sugar of about 2080 nm is discernible, the method comprising detecting the absorption of this beam of light in the products by measuring the intensity of the light which is reflected by the products at said wavelength of the beam of light and generating said detection signal on the basis of said absorption.

12. The method according to claim 9, wherein said component is formed of nicotine and said suitable products contain no concentration or a specific concentration of nicotine and are discerned from said anomalous products containing nicotine in an anomalous concentration, wherein said beam of light comprises light having a wavelength of some 1419 nm of 2270 nm, or having a wavelength for which an absorption peak for nicotine of some 1419 nm or some 2270 nm is discernible, the method comprising detecting the absorption of this beam of light in the products by measuring the intensity of the light which is reflected by the products at said wavelength of the beam of light and generating said detection signal on the basis of said absorption.

13. The method according to claim 9, wherein said component is formed of starch and said suitable products contain no concentration or a specific concentration of starch and are discerned from said anomalous products containing starch in an anomalous concentration, wherein said beam of light comprises light having a wavelength of some 918 nm, 979 nm, 1430 nm, 1700 nm, 1928 nm, 2100 nm, 2282 nm, 2320 nm or 2485 nm or having a wavelength for which an absorption peak for starch corresponding to at least one of said wavelengths is discernible, the method comprising detecting the absorption of this beam of light in the products by measuring the intensity of the light which is reflected by the products at said wavelength of the beam of light and generating said detection signal on the basis of said absorption.

14. The method according to claim 9, wherein said component is formed of oil, in particular vegetable oil, and said suitable products contain no concentration or a specific concentration of oil and are discerned from said anomalous products containing oil in an anomalous concentration, wherein said beam of light comprises light having a wavelength of some 1161 nm, 1212 nm, 1387 nm, 1703 nm, 1722 nm, 1760 nm, 2142 nm, 2306 nm or 2342 nm or having a wavelength for which an absorption peak for oil corresponding to at least one of said wavelengths is discernible, the method comprising detecting the absorption of this beam of light in the products by measuring the intensity of the light which is reflected by the products at said wavelength of the beam of light and generating said detection signal on the basis of said absorption.

15. The method according to claim 9, wherein said component is formed of water, and said suitable products contain no concentration or a specific concentration of water and are discerned from said anomalous products containing water in an anomalous concentration, wherein said beam of light comprises light having a wavelength of some 760 nm, 970 nm, 1190 nm, 1450 nm, 1550 nm or 1940 nm or having a wavelength for which an absorption peak for water corresponding to at least one of said wavelengths is discernible, the method comprising detecting the absorption of this beam of light in the products by measuring the intensity of the light which is reflected by the products at said wavelength of the beam of light and generating said detection signal on the basis of said absorption.

16. The method according to claim 9, wherein said component is formed of cellulose, and said suitable products contain no concentration or a specific concentration of cellulose and are discerned from said anomalous products containing water in an anomalous concentration, wherein said beam of light comprises light having a wavelength of some 978 nm, 1363 nm, 1425 nm, 1460 nm, 1702 nm, 1825 nm, 2079 nm, 2103 nm, 2268 nm, 2335 nm, 2355 nm of 2480 nm or having a wavelength for which an absorption peak for cellulose corresponding to at least one of said wavelengths is discernible, the method comprising detecting the absorption of this beam of light in the products by measuring the intensity of the light which is reflected by the products at said wavelength of the beam of light and generating said detection signal on the basis of said absorption.

17. The method according to claim 9, the method further comprising:

moving said products in a wide flow having a thickness of about a single product; and moving said beam of light crosswise over the width of the product flow, such that the beam of light scans said products.

18. The method according to claim 9, the method comprising generating said detection signal by comparing the absorption detected at a first wavelength, where a suitable product and an anomalous product represent an absorption of the beam of light by said component to practically the same extent, with the absorption by that component detected at a second wavelength, where a suitable product and an anomalous product represent a different absorption by said component.

19. The method according to claim 18, the method comprising generating said detection signal by calculating the difference between the detected absorption at said first wavelength and the one at said second wavelength, and by dividing this difference by the sum of the detected absorption at said first wavelength and said second wavelength.

20. The method according to claim 9, wherein said component is formed of water and the method comprises detecting the absorption of said beam of light by the products at a wavelength of at least 760 nm, 970 nm, 1200 nm, 1450 nm, 1550 nm and/or 1940 nm.

21. The method according to claim 9, wherein said component is formed of water, oil, sugar, proteins, starch, cellulose and/or nicotine.

22. The method according to claim 9, wherein said beam of light comprises a laser beam.

23. The method according to claim 9, wherein said beam of light is generated by a supercontinuum light source.

24. The method according to claim 9, the method further comprising controlling a removal device on the basis of said detection signal in order to separate anomalous products from the flow of products to be sorted.

25. The method according to claim 9, the method comprising detecting said absorption by an Indium Gallium Arsenide photo detector.

26. The method according to claim 9, the method further comprising:

sorting a mixture of products containing different components by selecting at least one absorption peak for each component on the basis of which one wishes to sort the products, detecting absorption of the beam of light by the products at the selected absorption peak for the different components, and, generating said detection signal a function of the detected absorption of the beam of light by the products for the wavelengths or the wavelength bands of the absorption peaks for said different components.

27. The method according to claim 26, wherein said component is formed of water, oil, sugar, proteins, starch, cellulose and/or nicotine.

* * * * *